US006502957B1

(12) United States Patent
Klaitman

(10) Patent No.: US 6,502,957 B1
(45) Date of Patent: Jan. 7, 2003

(54) PORTABLE LIGHTING FIXTURE ASSEMBLY

(76) Inventor: Louis Klaitman, 407 N. Paca St., Baltimore, MD (US) 21201

( * ) Notice: Subject to any disclaimer, the term of this patent is extended or adjusted under 35 U.S.C. 154(b) by 6 days.

(21) Appl. No.: 09/832,983

(22) Filed: Apr. 12, 2001

Related U.S. Application Data

(60) Provisional application No. 60/225,401, filed on Aug. 15, 2000.

(51) Int. Cl.[7] ..... A47F 5/00

(52) U.S. Cl. ..... 362/250; 362/249; 362/145; 362/252; 362/396; 362/431

(58) Field of Search ..... 362/249, 250, 362/252, 238, 239, 413, 414, 431, 184, 198, 287, 418, 396, 145; 52/28; 135/91

(56) References Cited

U.S. PATENT DOCUMENTS 638,895 A * 12/1899 Wallis ..... 362/249
2,642,246 A * 6/1953 Stephans ..... 362/249
2,712,056 A * 6/1955 Murray ..... 362/249
2,922,031 A * 1/1960 Stiffel ..... 362/250
3,012,801 A * 12/1961 Cole ..... 362/249
3,388,249 A * 6/1968 Siegel et al. ..... 362/250
6,035,876 A * 3/2000 Stover et al. ..... 135/98
6,279,753 B1 * 8/2002 Swanson ..... 211/13.1

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

A portable lighting fixture assembly (10) for detachably coupling to a frame member of a partition or other such structural system is provided. The portable lighting fixture assembly (10) generally comprises a base portion (100) and a lighting portion (200) coupled thereto for illuminating a display area defined by the partition system. The base portion (100) includes a deck member (110) and an elongate coupling member (20) extending transversely from that deck member (110) for telescopically engaging the frame member. The lighting portion (200) includes at least one lighting fixture (210) having an extension arm (212) projecting from the deck member (110). Each lighting fixture (210) terminates at a lighting source (216) coupled to a free end (214) of its extension arm (212). The portable lighting fixture assembly (10) is thereby securely seated on the frame member to illuminate the display area.

20 Claims, 14 Drawing Sheets

PORTABLE LIGHTING FIXTURE ASSEMBLY

RELATED PATENT INFORMATION

This Patent Application is based upon U.S. Provisional Patent Application, Ser. No. 60/225,401, filed Aug. 15, 2000.

BACKGROUND OF THE INVENTION

1. Field of the Invention

The subject portable lighting fixture assembly is generally directed to a portable assembly for adaptive use in numerous settings and applications. More specifically, the portable lighting fixture assembly is directed to an assembly that may easily and conveniently yet in a highly secure and adaptive manner be mounted to a structural frame member of, for instance, a space partition.

A common problem encountered by those utilizing temporary structures such as display booths, compartmentalized work cubicles, and the like is the unavailability of ready means for amply lighting the given area. The partitioned area is, in most cases, defined simply by a plurality of standing wall or partitioning members. Without a ceiling or other overhead member on which to suspend overhead lamps or other lighting fixtures, the user is relegated to securing the required lighting fixtures somehow on the standing partition structure. Freestanding lamps may be employed; however, space limitations in most applications do not afford such use of freestanding lamp structures, at least not in both safe and effective manner.

Accordingly, designs of lighting fixtures and brackets attachable to various portions of partitioning members abound. As partitioning members invariably include a plurality of elongate frame members; known lighting fixture/bracket designs seek to yield a secure coupling to such frame members for adequate positioning and orientation of the required lighting source. Many designs, for instance, employ a bracket that adjustably clamps onto either a vertical or horizontal partition frame member, suspending a light source therefrom via an extension arm. Other designs employ in similar manner brackets which either hang or are secured by fastener to a partition frame member.

Numerous practical drawbacks result from such known designs. First, the strength and stability of the coupling of bracket and frame members is in each design far from secure, particularly since the frame members tend to be configured with a cylindrical, tubular contour. Among other things, this poses a potentially dangerous situation, for high intensity lamps of wattages on the order of 300 are typically used in many applications. An unintentional decoupling of the bracket from a frame member would then permit an intensely hot lamp to contact and burn persons or items in the immediate vicinity.

What is more, without reinforcing the coupling with extraneous fastening hardware or, simply, with a cumbersome and unsightly wrap of tape, the type, configuration, and number of lighting sources that may be adequately supported from any one given bracket becomes prohibitively limiting. A great number of individual lighting fixtures, along with their respective brackets and reinforcing measures, must tediously be coupled individually to appropriate frame members in order to obtain adequate lighting. This significantly burdens not only the user's set-up and take-down efforts, it burdens him or her with the need to manage a great number of discrete, misplaceable parts.

There is, therefore, significant need for a portable lighting fixture that may be quickly, conveniently—yet securely—coupled to one or more frame members of a partition structure. There is a significant need, moreover, for such a portable lighting fixture assembly having one or more light sources that may be readily adapted in position and orientation to a given application. There is a further need for such a portable lighting fixture assembly that may be coupled to a partition frame member with sufficient stability to support lighting sources quite varied in type, configuration, and number.

2. Prior Art

Lighting fixture assemblies for use in illuminating a display area defined by a partition frame system are known in the art. The best prior art known to Applicant includes U.S. Pat. Nos. 6,036,337; 6,042,251; 6,079,851; 6,079,992; 5,967,649; 6,068,381; 5,436,811; and, 5,483,432. The known prior art also includes a family of lights, light fixtures, and brackets marketed by LIGHT CRAFT MANUFACTURING, INC. of Fremont, Ohio, such as the dual arm extension fixture Model No. SL-514. Such known devices, however, are either affixed to partition frame members by bolt-down or other such permanent fastening means, or else lack security and stability in coupling to the given partition system.

For instance, the dual arm extension fixture Model No. SL-514 includes a pair of arms, the free ends of which together support a bulb light source. The other ends of the arms are mounted to a mounting bracket whose bolt-down plate is, in turn, fastened by bolts to an intermediate portion of a horizontally extended cross frame member. This and other such lighting assemblies known in the art fail to provide the combination of flexibility, convenience, stability, and safety that enables a user to quickly and confidently couple the assembly in adaptive manner to a given partition system for adequate lighting of the desired display area.

SUMMARY OF THE INVENTION

It is a primary object of the present invention to provide a portable lighting fixture assembly having one or more light sources that may be detachably yet securely coupled to a frame member to illuminate a display area about the frame member in highly effective manner.

It is another object of the present invention to provide a portable lighting fixture assembly which secures detachably to one or more frame members of a partitioned system to adjustably illuminate a display area defined by the partition system.

These and other objects are attained by a portable lighting fixture assembly formed in accordance with the present invention. The subject portable lighting fixture assembly generally comprises a base portion adapted for detachable coupling to a frame member, and a lighting portion coupled thereto for illuminating a display area. The base portion includes a deck member and an elongate coupling member extending transversely from the deck member for telescopically engaging a frame member. The lighting portion includes at least one lighting fixture having an extension arm projecting from the deck member. Each lighting fixture terminates at a lighting source coupled to a free end of its extension arm.

Preferably, at least a portion of the extension arm of a lighting fixture is malleable in configuration, being formed in one preferred embodiment with a metallic flex configuration. The base portion preferably defines a substantially planar platform, and each extension arm of a lighting fixture projects from that platform. The base portion's coupling member is preferably formed with a substantially tubular contour defmed by a side wall part that extends longitudinally downward, and has formed therein at least one longitudinal slot for receiving therethrough a hooking element of a cross frame member.

In certain embodiments, the base portion's coupling member is configured for telescopically receiving therein an upper portion of a vertical frame member. In other embodiments, the base portion's coupling member is configured for telescopic insert into an upper portion of a vertical frame member. Where the given vertical frame member is formed with a side wall portion having a longitudinal slot therein to engage the hooking element of a cross frame member, the longitudinal slot formed in the side wall part of the base portion's coupling member is disposed in alignment therewith.

DETAILED DESCRIPTION OF THE PREFERRED EMBODIMENTS

Figure 1:
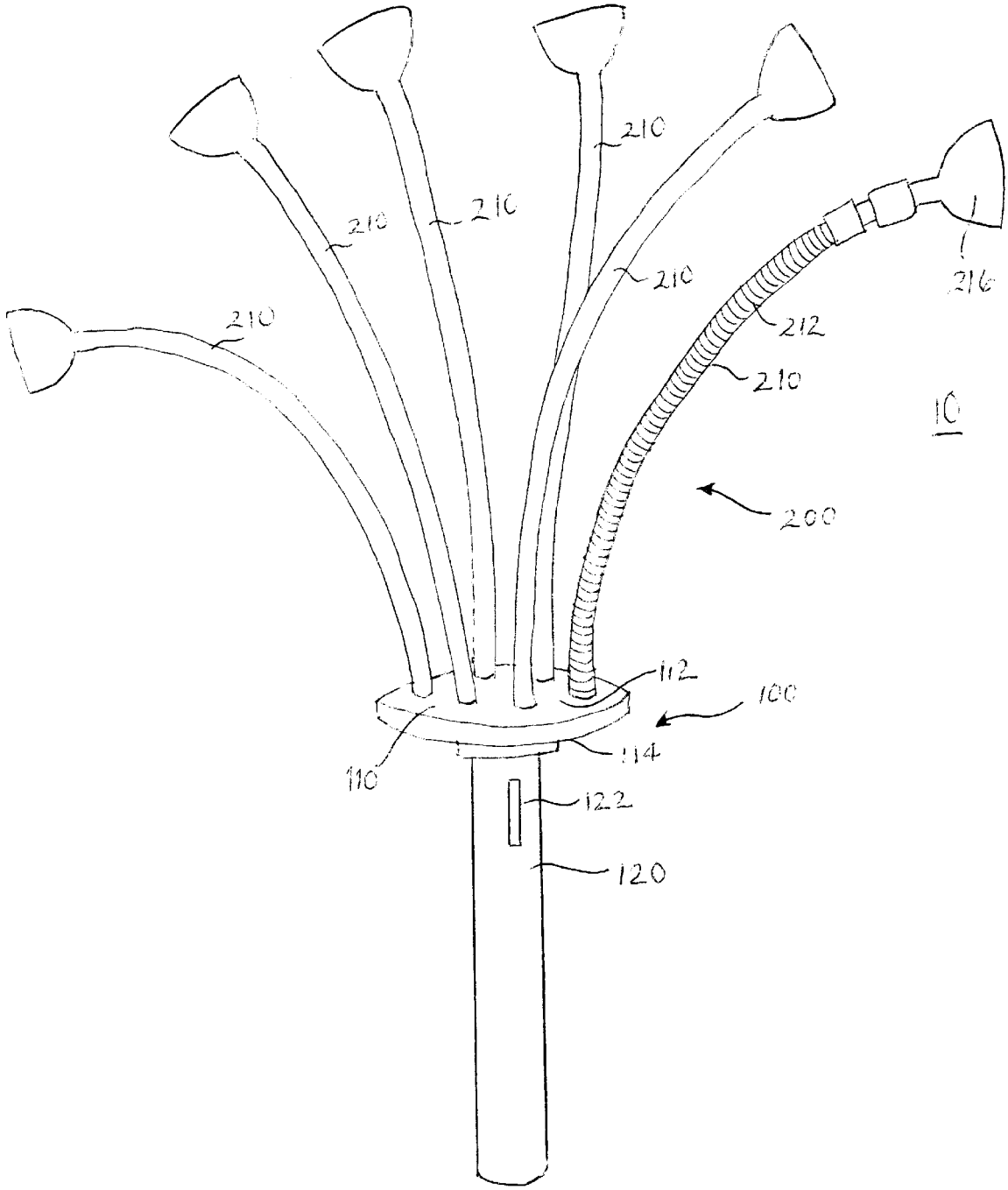
FIG. 1 is an illustrative perspective view of one embodiment of the present invention.

Referring now to FIG. 1, there is illustrated an exemplary embodiment of a portable lighting fixture assembly 10 formed in accordance with the present invention. For purposes of clarity, details such as electric cords that may be necessary for any non-battery powered light sources utilized and details identically replicated in each of the lighting source extensions are not shown.

Portable lighting fixture assembly 10 generally comprises a base portion 100 and a lighting portion 200 supported thereby. Base portion 100 preferably includes a deck member 110 from which extends an elongate coupling member 120. Deck member 110 preferably provides a substantially planar platform 112 on which lighting portion 200 may be amply supported in stable manner. Deck member 10 also defines a shoulder 114 disposed radially about the upper end of coupling member 120 to, in certain embodiments, abut and engage portions of the partition frame member to which coupling member 120 may be coupled, as described in following paragraphs.

Figures 2, 3, 4:
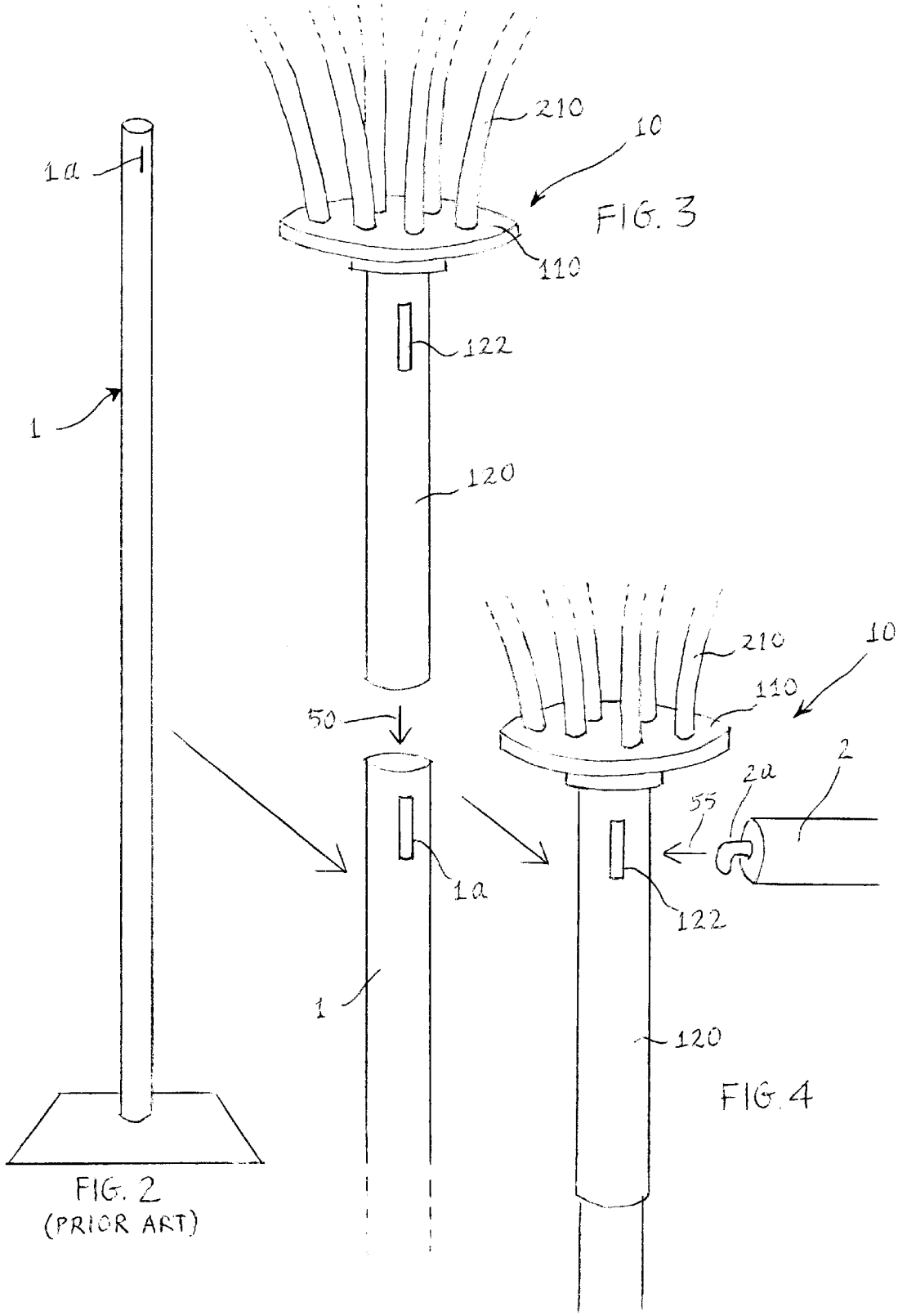
FIG. 2 (PRIOR ART)
FIG. 2 is an illustrative perspective view of a vertical partition frame member known in the prior art.
FIG. 3 is an illustrative perspective view illustrating the coupling of the embodiment of the present invention shown in FIG. 1 with the vertical partition frame member.
FIG. 4 is an illustrative perspective view, partially cutaway, of the embodiment of the present invention shown in FIG. 1 coupled to a vertical partition frame member.

Coupling member 120 is formed with a suitable configuration to realize substantially flush telescopic engagement with a partition frame member (shown in FIG. 2). So as to accommodate any connecting holes in the partition frame member to which it is telescopically engaged, coupling member 120 includes one or more slots 122 configured and positioned as required for the particular configuration of the partition frame member employed in the intended application.

Preferably, deck member 110 and coupling member 120 are each formed of a metallic material and coupled one to the other in fixedly secured manner. One or both of the deck and coupling members 110, 120 may alternatively be formed of other materials having the sufficient strength, rigidity, and durability to withstand the mechanical and thermal loads to which they may be subjected during use in the intended application(s). In addition, coupling member 120 may be formed with a contour and configuration other than that shown in the exemplary embodiment, so long as it forms a sufficiently stable telescopic engagement with the given partition frame member. For example, coupling member 120 may be formed with a rectangular, oblong, or other sectional contour, depending on the given frame member's contour and configuration. Depending on the intended application (s), it may be formed with either the tubular configuration shown or a non-tubular configuration. Deck member 110 may, likewise, be formed with any other suitable contour and configuration than that shown, so long as it forms a sufficient structural foundation for the coupling of lighting portion 200 thereto.

Lighting portion 200 includes one or more lighting fixtures 210. Each lighting fixture 210 preferably includes an extension arm 212 securely coupled at one end to base member 110 and having coupled at another end thereof—terminal end 214—an incandescent lamp bulb, or any other suitable lighting source 216 (fluorescent, halogen, etc.). For enhanced adjustability, extension arm 212 is preferably embodied in malleable form using any suitable measures known in the art. Note, however, extension arm 212 of one or more lighting fixtures 210 may alternatively be embodied in rigid form. In certain embodiments, of course, a plurality of lighting fixtures 210 may be employed respectively having various combinations of both rigid and malleable extension arms 212. Similarly, a plurality of lighting fixtures 210 may be employed in certain embodiments wherein varying combinations of type and configuration for lighting source 216 are be used.

If the lighting source 216 employed in a particular lighting fixture 210 is driven via an electric power cord, that power cord (not shown) may be internally routed through the given extension arm 212, and base portion 100. The electric power cord may alternatively be, simply, routed (and fastened) along the outer surface of the given extension arm 212 and appropriate sections of base portion 100 (as shown in FIGS. 7–16).

Although the extension arm 212 and terminal end 214 of each lighting fixture 210 are preferably formed of a metallic material, they may alternatively be formed of any other suitable material known in the art, such as plastic, dense rubber, or the like having the mechanical and/or electrical properties required for the intended application. Also, the sectioned, metallic flex configuration of extension arm 212 in the embodiment shown may be substituted by any other configuration known in the art suitable for the requirements of the intended application.

Turning now to FIG. 2, there is illustrated an exemplary partition frame member 1 commonly employed in the prior art to form freestanding partitions for temporary exhibition booths used at conventions, trade shows, and the like. This vertical, or upright, frame member 1 is typically formed with a connection slot 1*a* which accomodates a hooking element extending axially from the end of a horizontal, or cross, frame member 2 (FIG. 4) that extends between a pair of vertical frame members 1 to form a partition wall frame.

Referring to FIGS. 3–4, the coupling of the subject portable lighting fixture assembly 10 to a vertical partition frame member 1 is illustrated. As shown, coupling member 120 of assembly 10 is configured with a cylindrical, substantially tubular contour appropriately dimensioned such that when coaxially coupled to an upper portion of partition frame member 1 (as indicated by the directional arrow 50), coupling member 120 fits telescopically about that upper portion of the partition frame member 1. Slot 122 may then be aligned with the partition frame member's slot 1*a*, such that the coupling of the partition cross frame member's hook element 2*a* to the vertical partition frame member 1 (indicated by the directional arrow 55) may not be obstructed.

Thus engaged to the partition frame members, the subject assembly 10 is firmly and securely seated—obviating the need for any extraneous fastening or securing hardware. If malleable extension arms 212 are employed, the user may then adjust the positions and orientations of the individual lighting fixtures 210 to direct the light sources coupled thereto in the desired manner without fear of disturbing or de-stabilizing the assembly's coupling to the partition frame.

One or more portable lighting fixture assemblies 10 may be employed to yield the required lighting. The extremely secure coupling of assembly 10 to the partition frame members permits a relatively great number of lighting fixtures 210 to be supported on a common base portion 100. The user is able, therefore, to set up and establish ample lighting without the excessive investment of time and effort, and without the handling of numerous individual hardware components that would invariably be required otherwise.

Figure 5:
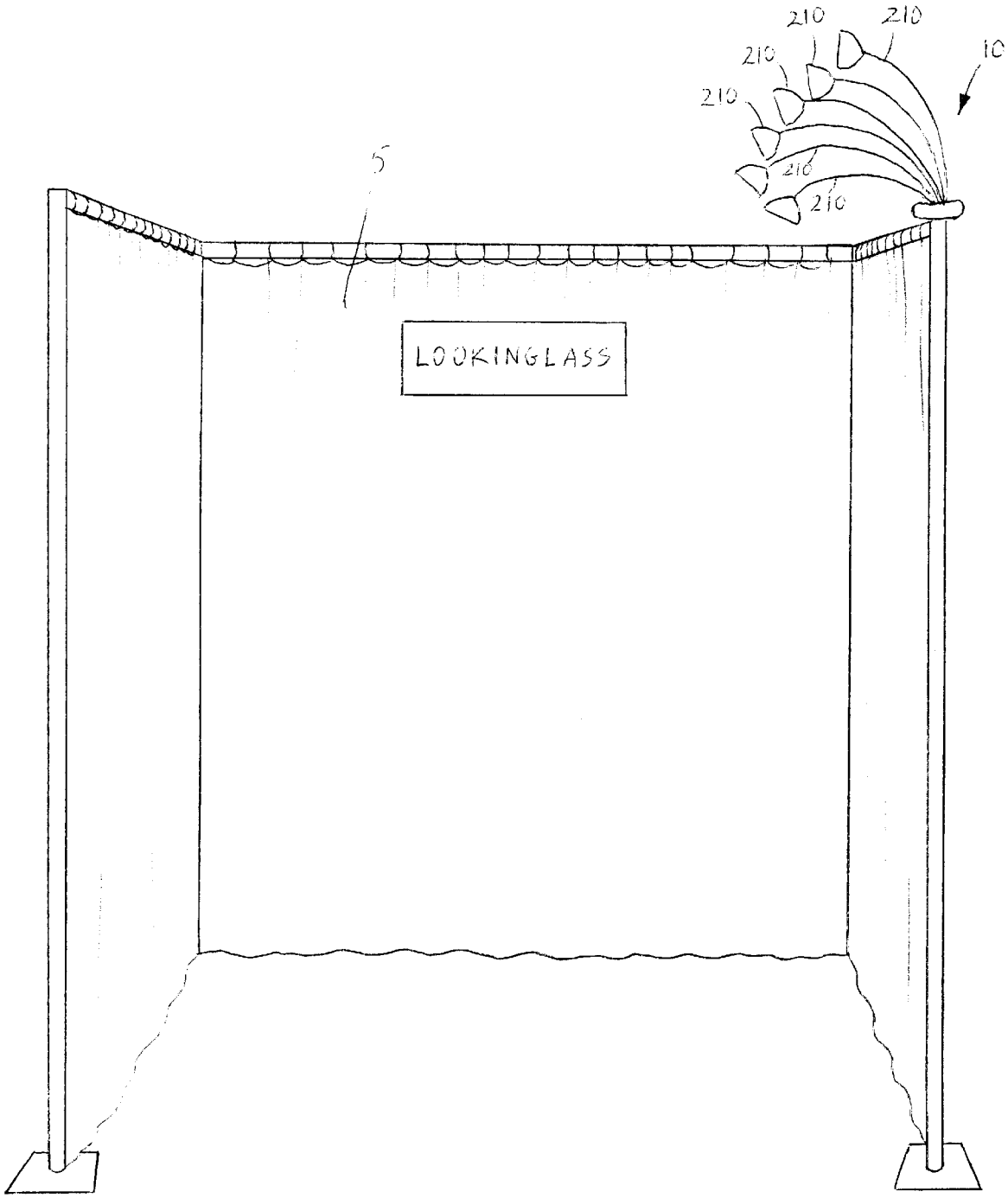
FIG. 5 is an illustrative perspective view of a first exemplary application of the embodiment of the present invention shown in FIG. 1.
Figure 6:
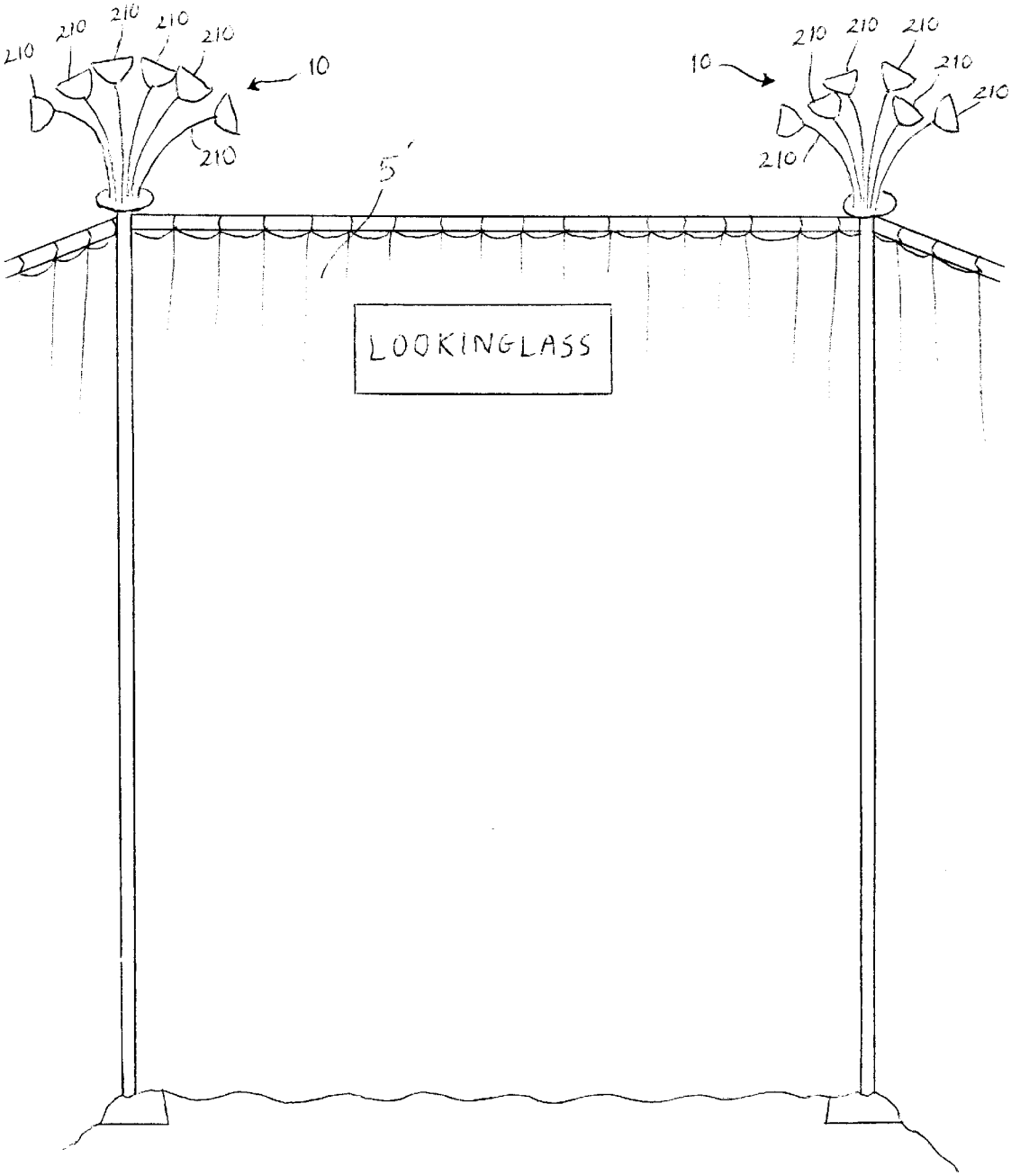
FIG. 6 is an illustrative perspective view of a second exemplary application of the embodiment of the present invention shown in FIG. 1; and, FIGS. 7–16 are graphic reproductions showing various portions of a second embodiment of the present invention.

Turning now to FIGS. 5 and 6, there are shown exemplary applications in which one or more of the subject portable lighting fixture assemblies 10 may be employed. As shown, the lighting sources of each assembly 10 are securely retained well out of the way of any person or item within a booth 5, 5' established as shown. The individual lighting fixtures 210 may then be directed as needed to provide the desired illumination.

Referring to FIGS. 7–16, there are shown various views of the subject portable lighting fixture assembly 10' formed in accordance with another embodiment of the present invention. For the purposes of clarity, some of the elements shown in the embodiment of FIGS. 1–6 which remain unchanged in this embodiment have not been separately marked with their reference numbers. Note, however, that the electric cords leading from each of the lighting sources of lighting fixtures 210 are shown routed along and clipped to their respective extension arms 212.

Figure 7:
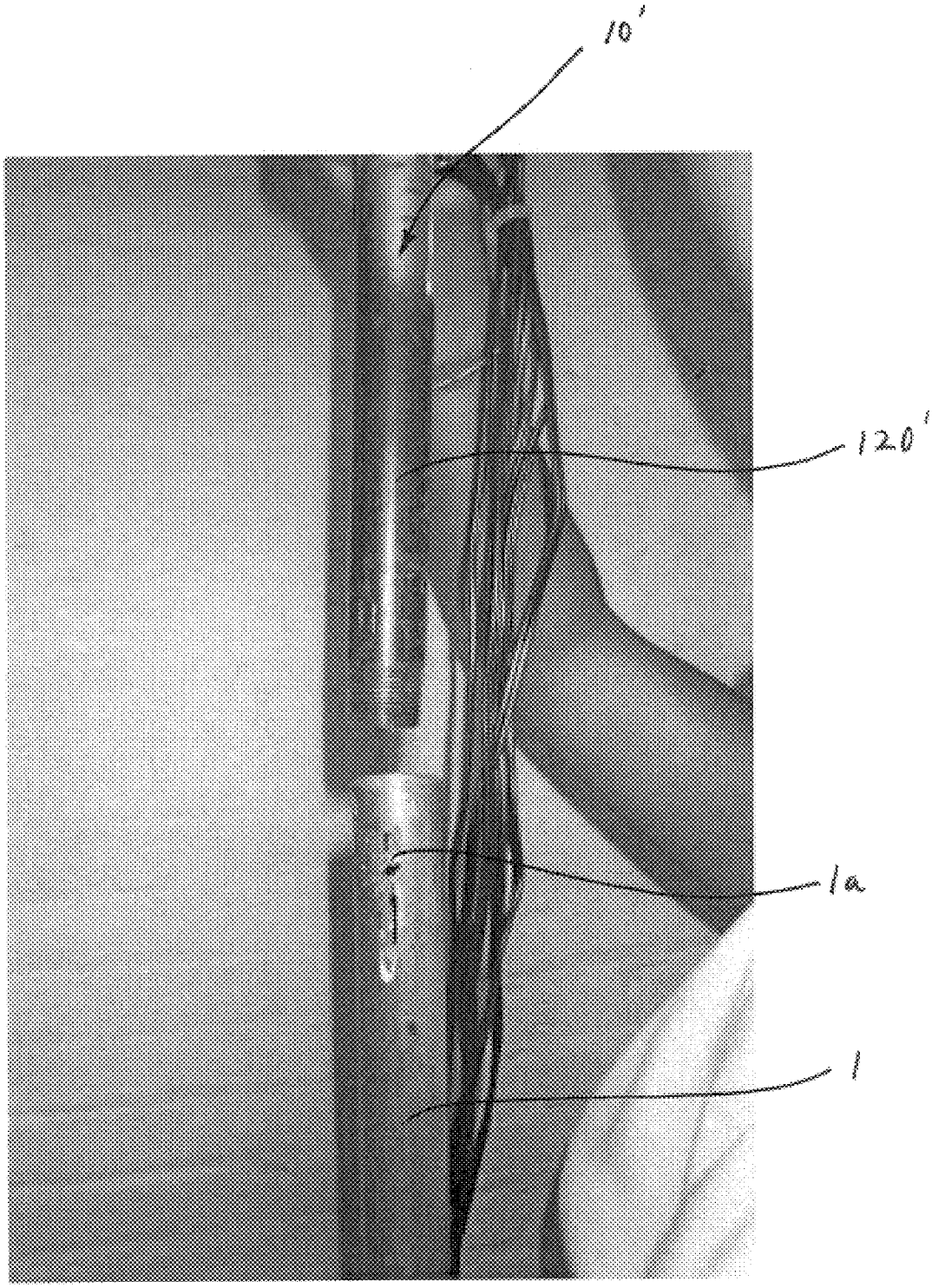
Figure 8:
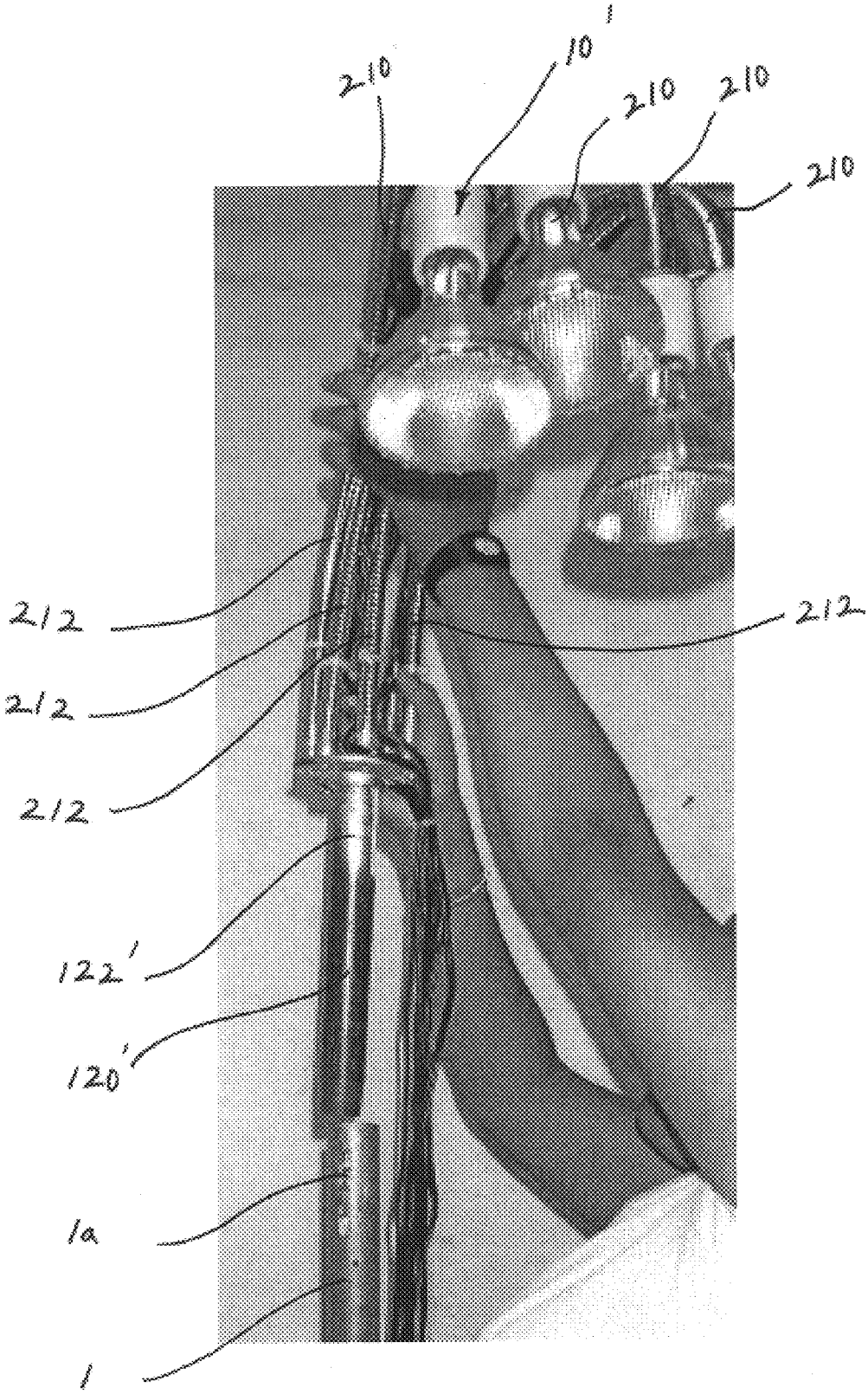
Figure 9:
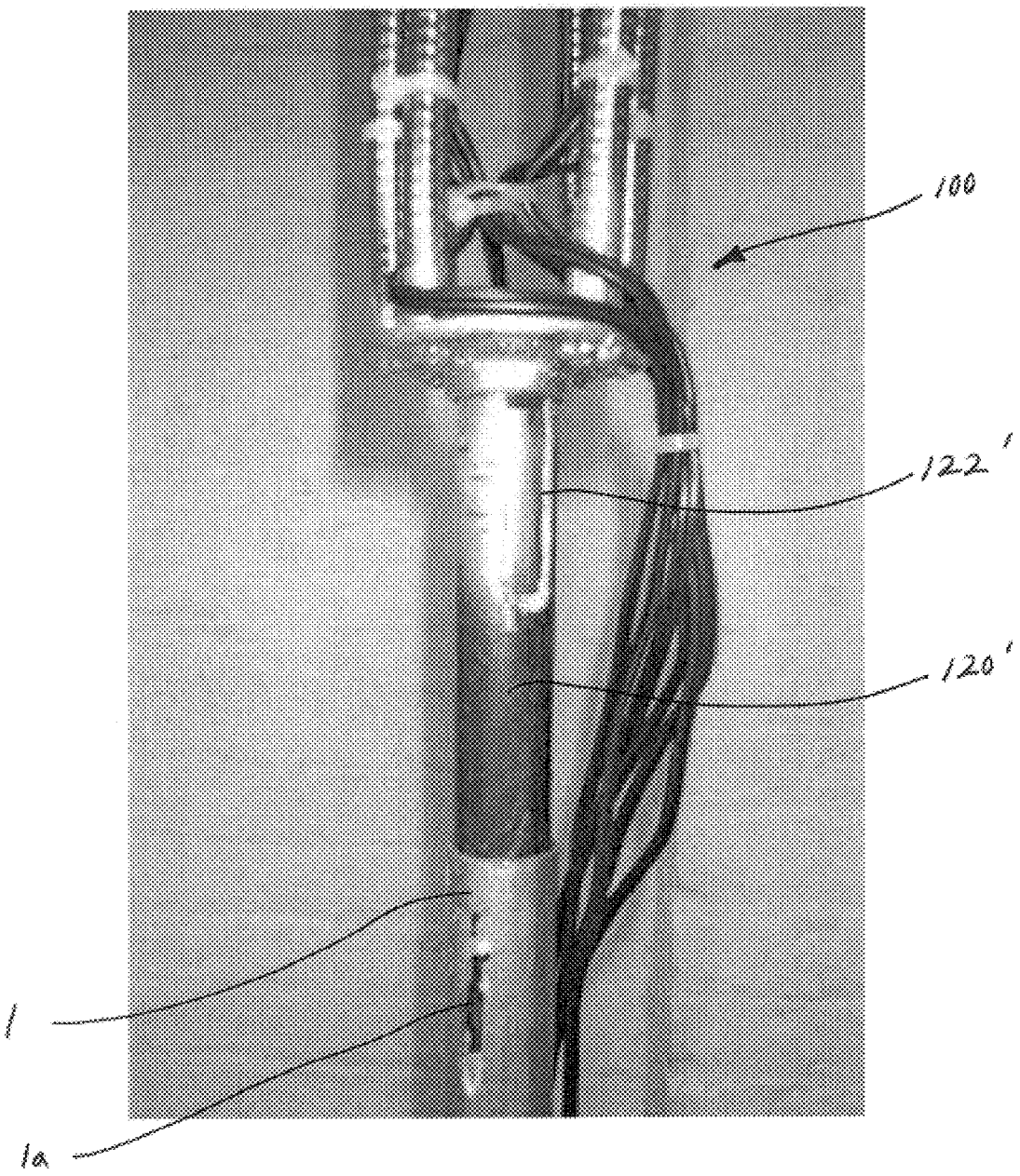
Figure 10:
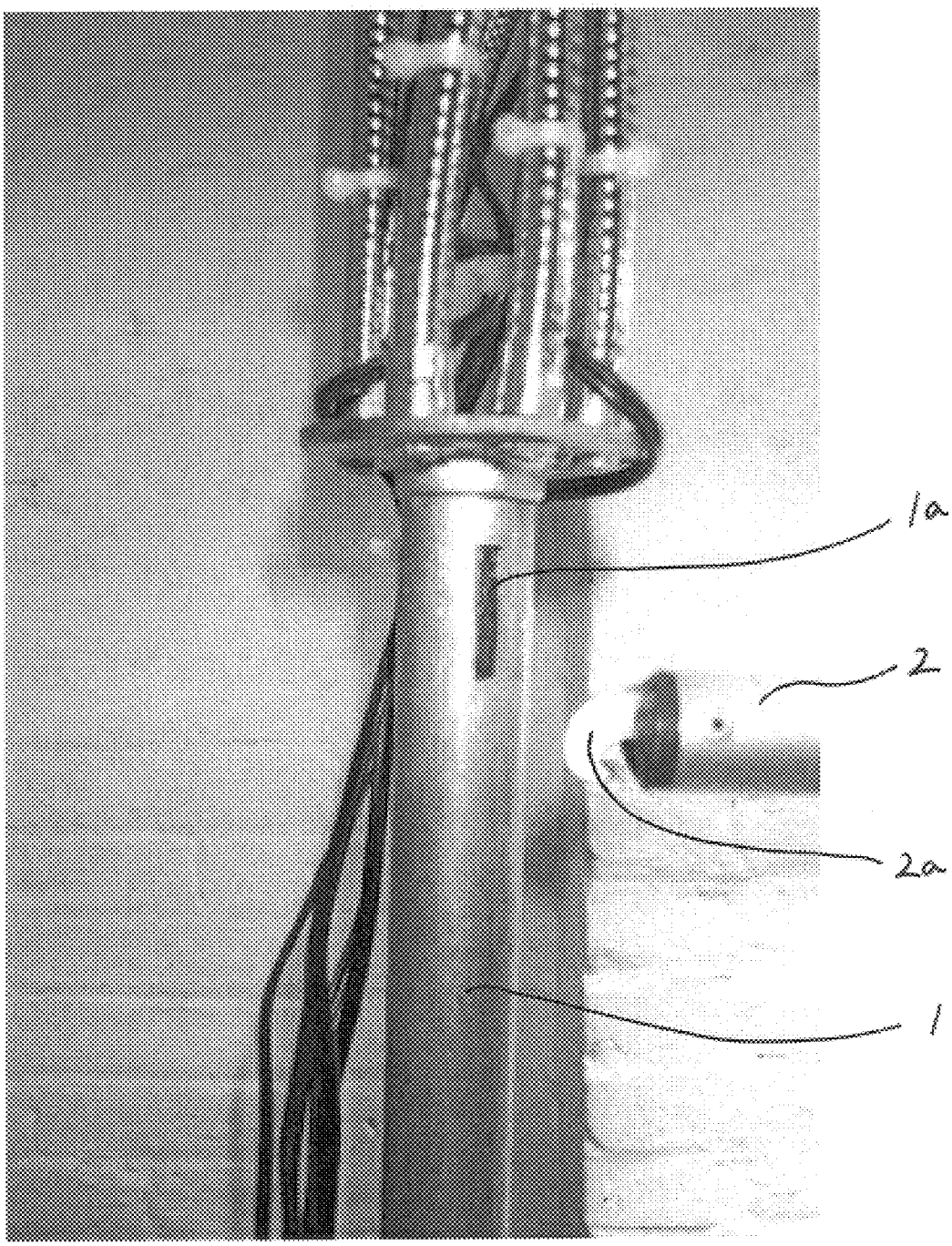
Figure 11:
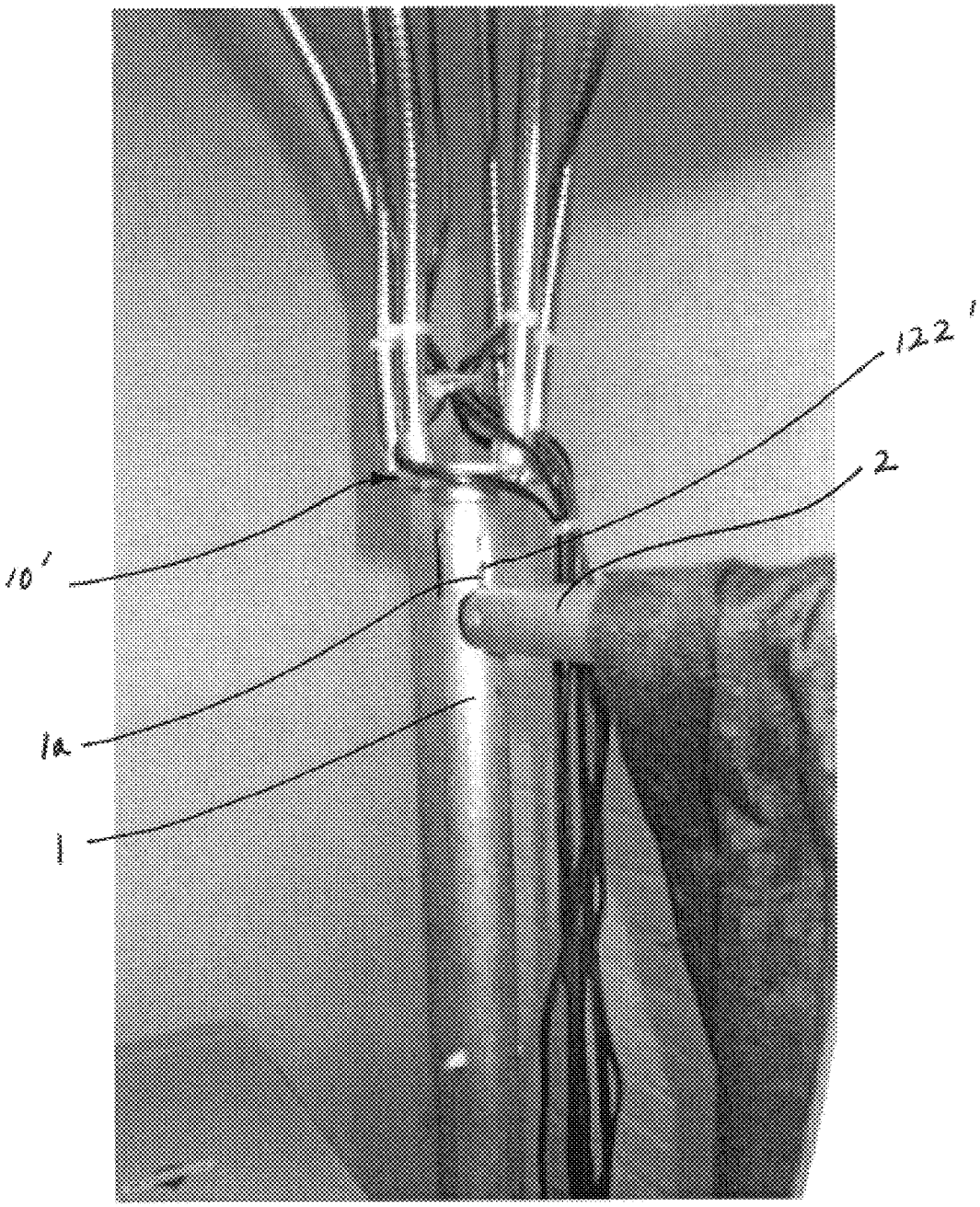

As shown most clearly in FIGS. 7 and 9, coupling member 120' of the assembly's base portion 100 is contoured and dimensioned in this embodiment to coaxially insert within an upper portion of a vertical partition frame member 1, with shoulder 114 abutting the terminal end of that frame member's upper portion. Coupling member 120' is formed with a slot 122' which aligns with the vertical partition frame member's connecting slot 1*a*. As before, this enables the hooking element 2*a* of a horizontal partition frame member 2 to engage the connecting slot 1*a* of the vertical partition frame member 1 unobstructed.

Figure 12:
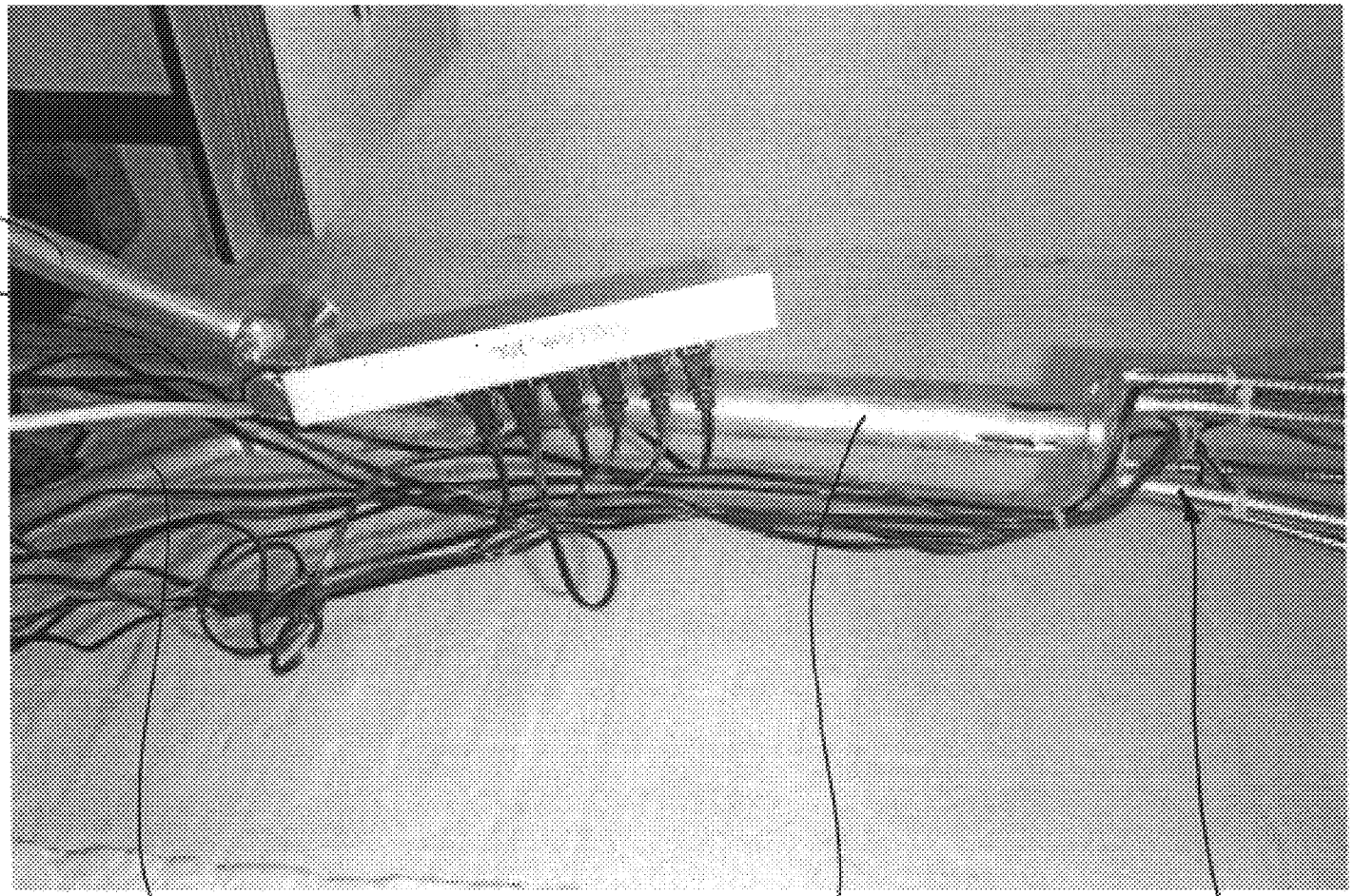
Figure 13:
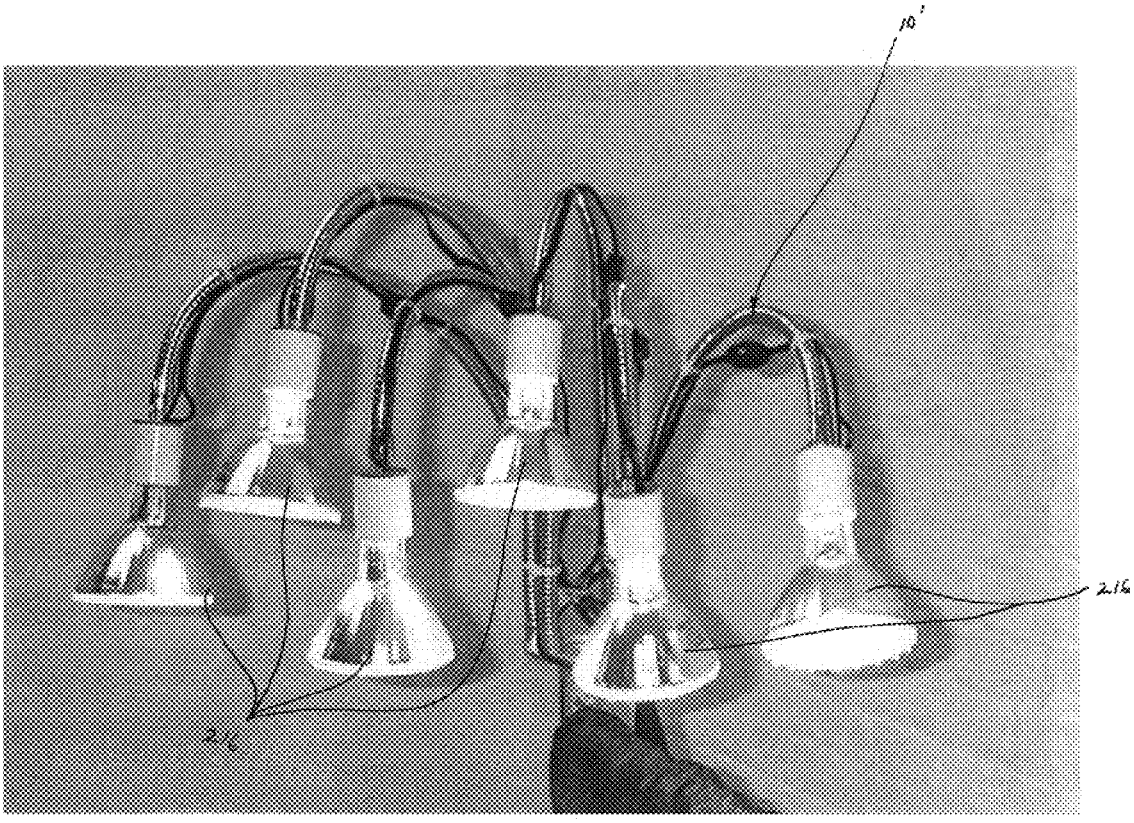
Figure 14:
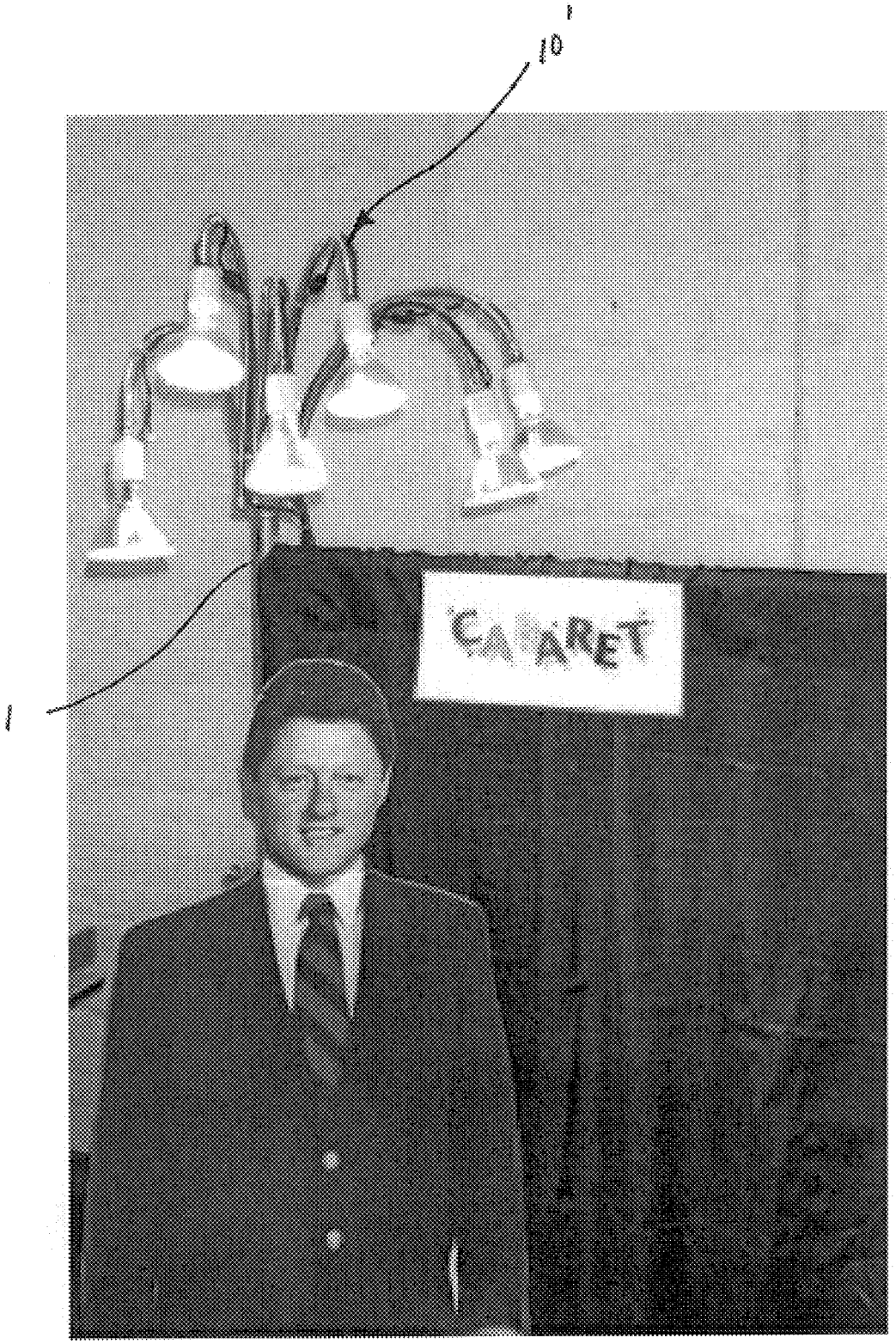
Figure 15:
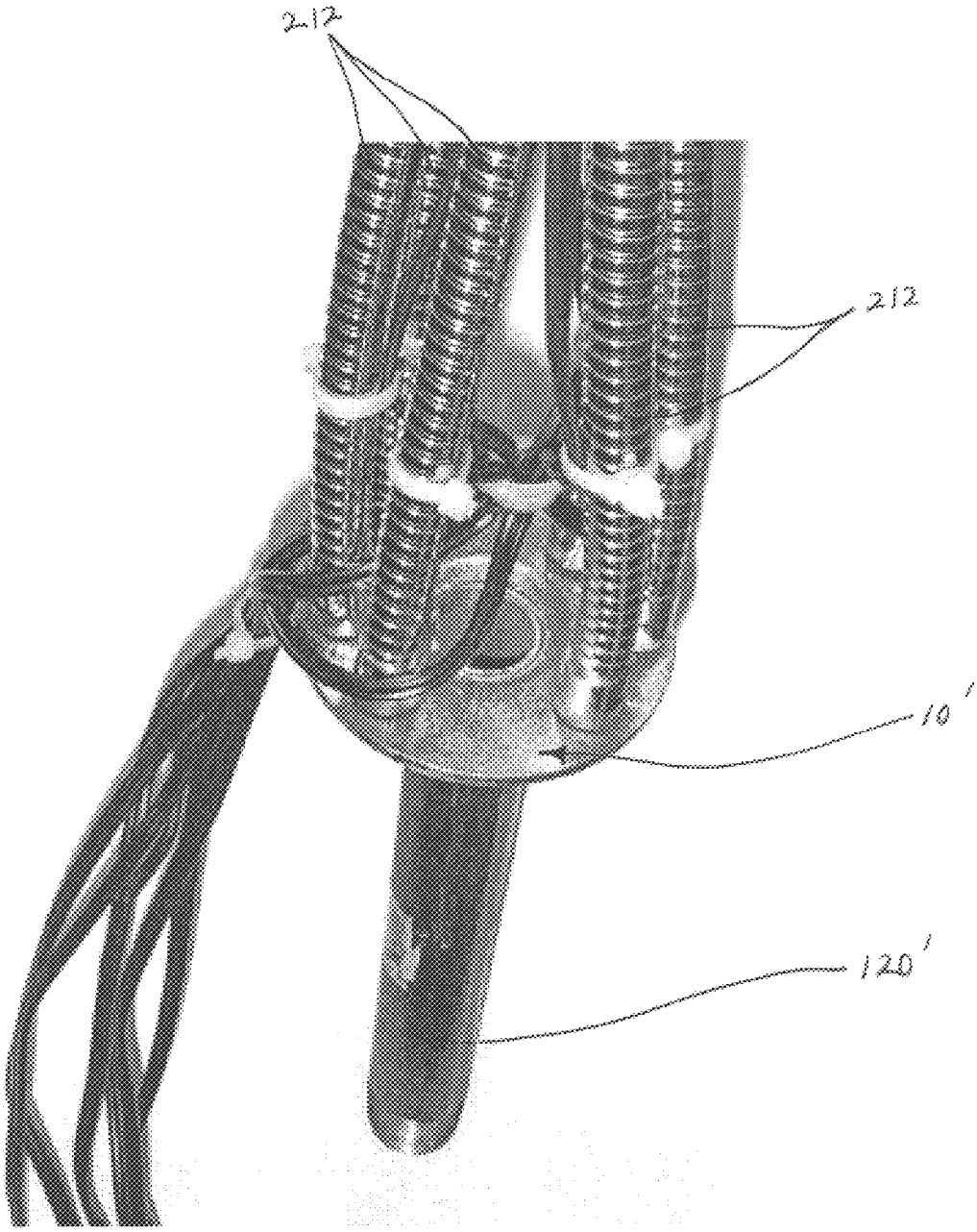
Figure 16:
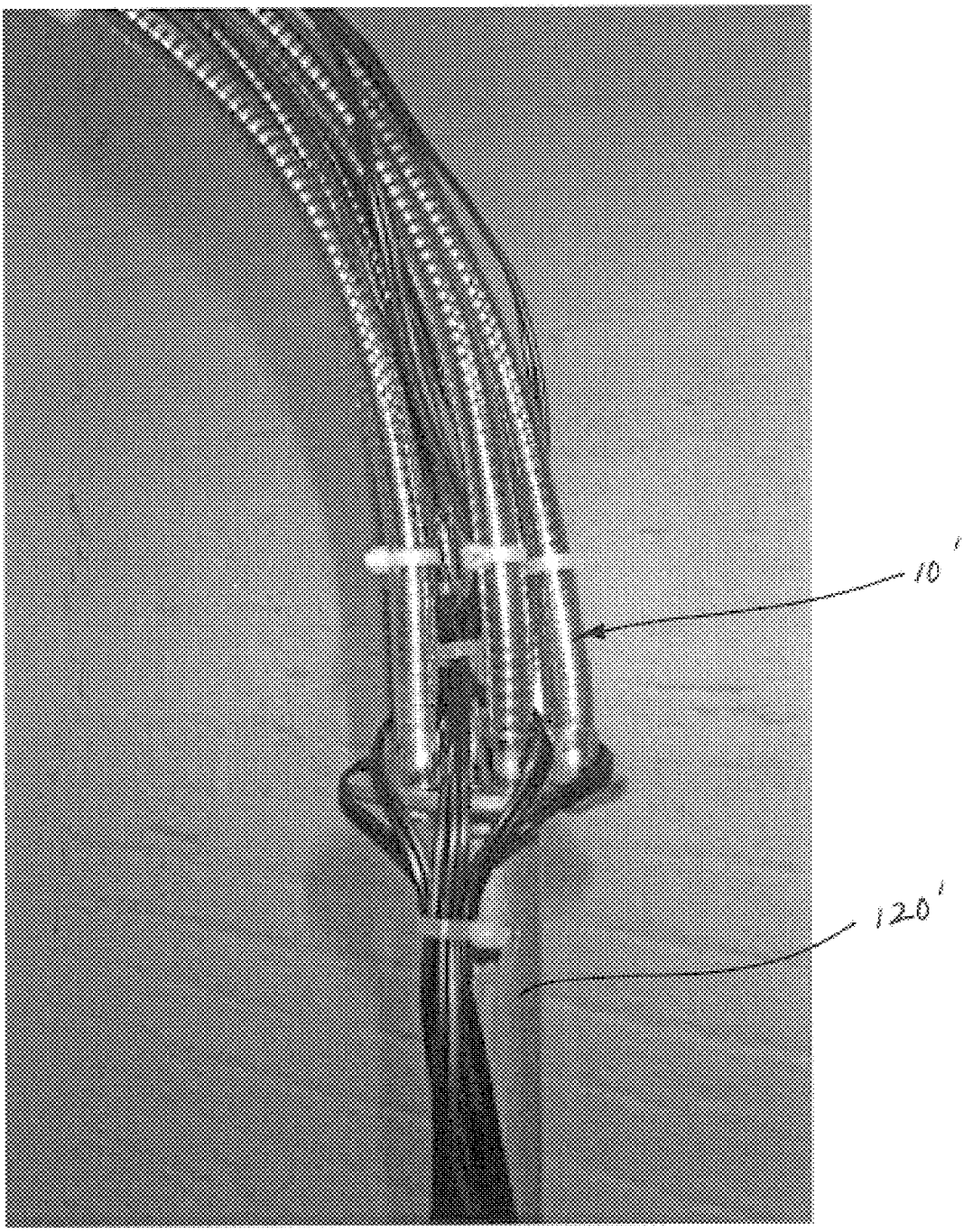

Note that use of the subject portable lighting fixture assembly 10 is not limited to the exemplary frame structures of the type shown in FIG. 2. Rather, assembly 10 may be conveniently engaged telescopically to any number of suitable frame structure types known in the art. In the embodiment of FIG. 12, for instance, lighting fixture assembly 10' is telescopically engaged to an upper portion of a vertical frame member 1 equipped with its own freestanding structure formed by a set of radiating legs 1', 1", 1'". Although not shown, other such frame structures may be employed, as may additional extraneous measures—like reinforcing/securing hardware—where the intended application so requires.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, and certain features may be used independently of other features, all without departing from the spirit or scope of the invention as defined in the appended Claims.

What is claimed is:

1. A portable lighting fixture assembly for detachable coupling to a frame member disposed about a display area comprising:

(a) a base portion, said base portion including a deck member defining a substantially planar platform, and an elongate coupling member extending transversely from said deck member for telescopically engaging a frame member, said coupling member of said base portion being formed with a substantially tubular contour defined by a sidewall part extending longitudinally downward, said coupling member having formed in said sidewall part at least one longitudinal slot for receiving therethrough a hooking element of a cross frame member; and, (b) a lighting portion having at least one lighting fixture coupled to said deck member for illuminating the display area, said lighting fixture including an elongate extension arm projecting from said platform of said deck member, said lighting fixture terminating at a lighting source coupled to a free end of said extension arm.

2. The portable lighting fixture assembly as recited in claim 1 wherein at least a portion of said extension arm of said lighting fixture is malleable in configuration.

3. The portable lighting fixture assembly as recited in claim 2 wherein at least a portion of said extension arm is formed with a metallic flex configuration.

4. The portable lighting fixture assembly as recited in claim 2 wherein said lighting portion includes a plurality of said lighting fixtures.

5. The portable lighting fixture assembly as recited in claim 1 further comprising a power cord for said lighting fixture routed along said extension arm thereof.

6. The portable lighting fixture assembly as recited in claim 5 wherein said extension arm is hollow, said power cord being routed to said lighting source through said extension arm thereof.

7. The portable lighting fixture assembly as recited in claim 1 wherein said coupling member of said base portion is configured for telescopically receiving therein an upper portion of a vertical frame member.

8. The portable lighting fixture assembly as recited in claim 1 wherein said coupling member of said base portion is configured for telescopic insert into an upper portion of a vertical frame member.

9. The portable lighting fixture assembly as recited in claim 8 wherein said base portion includes a shoulder formed below said deck member, said shoulder extending radially outward from said coupling member for engaging an end of said vertical frame member upper portion.

10. A portable lighting fixture assembly for detachable coupling to a frame member disposed about a display area comprising:

(a) a base portion, said base portion including a deck member defining a substantially planar platform, and an elongate coupling member extending longitudinally downward from said deck member for telescopically engaging a vertical frame member, said coupling member having a substantially tubular contour defined by a sidewall part, said coupling member having formed in said sidewall part at least one longitudinal slot for receiving therethrough a hooking element of a cross frame member; and, (b) a plurality of lighting fixtures coupled to said deck member for illuminating the display area, each said lighting fixture including an elongate extension arm projecting from said platform of said deck member, at least a portion of said extension arm of at least one said lighting fixture being malleable in configuration, each said lighting fixture terminating at a lighting source coupled to a free end of said extension arm.

11. The portable lighting fixture assembly as recited in claim 10 wherein at least a portion of each said extension arm is formed with a metallic flex configuration.

12. The portable lighting fixture assembly as recited in claim 11 further comprising a power cord for each said lighting fixture routed along said extension arm thereof.

13. The portable lighting fixture assembly as recited in claim 12 wherein each said extension arm is hollow, said power cord being routed to said lighting source through said extension arm thereof.

14. The portable lighting fixture assembly as recited in claim 10 wherein said coupling member of said base portion is configured for telescopically receiving therein an upper portion of a vertical frame member.

15. The portable lighting fixture assembly as recited in claim 10 wherein said coupling member of said base portion is configured for telescopic insert into an upper portion of a vertical frame member.

16. The portable lighting fixture assembly as recited in claim 15 wherein said base portion includes a shoulder formed below said deck member, said shoulder extending radially outward from said coupling member for engaging an end of said vertical frame member upper portion.

17. A collapsible partition system for reconfigurably partitioning and illuminating a display area comprising:

(a) a frame assembly including at least a pair of upright frame members spaced one from the other, and at least one cross frame member coupled thereto to extend transversely therebetween, at least one said upright frame member having a tubular contour defined by a sidewall portion, said sidewall portion having a longitudinally extended slot formed therein, said cross member having a hooking element formed at least at one end thereof, said hooking element lockingly engaging said slot of said upright frame member sidewall portion; and, (b) at least one lighting fixture assembly detachably coupled to said frame assembly, said lighting fixture including:

(1) a base portion coupled to one said upright frame member, said base portion including a deck member defining a substantially planar platform, and an elongate coupling member extending longitudinally downward therefrom to telescopically engage said upright frame member, said coupling member having a substantially tubular contour defined by a sidewall part, said coupling member having formed in said sidewall part at least one longitudinal slot disposed in alignment with said slot of said upright frame member to receive therethrough said hooking element of said cross frame member; and, (2) a plurality of lighting fixtures coupled to said deck member, each said lighting fixture including an elongate extension arm projecting from said platform of said deck member, at least a portion of said extension arm of at least one said lighting fixture being malleably formed with a metallic flex configuration, each said lighting fixture terminating at a lighting source coupled to a free end of said extension arm.

18. The collapsible partition system as recited in claim 17 wherein said sidewall part of said base portion coupling member of said light fixture assembly is substantially cylindrical in contour.

19. The collapsible partition system as recited in claim 18 wherein said an upper portion of said upright frame member is telescopically received in said coupling member of said light fixture assembly base portion.

20. The collapsible partition system as recited in claim 18 wherein said coupling member of said light fixture assembly base portion is telescopically inserted into an upper portion of said upright frame member.

* * * * *